US005172664A

United States Patent [19]

Mueller et al.

[11] Patent Number: 5,172,664

[45] Date of Patent: Dec. 22, 1992

[54] INCANDESCENT PLUG

[75] Inventors: Helmut Mueller, Besigheim-Ottmarsheim; Werner Baeskow, Hessigheim, both of Fed. Rep. of Germany

[73] Assignee: Beru Ruprecht GmbH & Co., KG, Ludwigsburg, Fed. Rep. of Germany

[21] Appl. No.: 694,960

[22] Filed: May 6, 1991

[30] Foreign Application Priority Data

May 4, 1990 [DE] Fed. Rep. of Germany ..... 4014356

[51] Int. Cl.[5] ..... F02P 19/02; H05B 3/18

[52] U.S. Cl. ..... 123/145 A; 219/270

[58] Field of Search ..... 123/145 R, 145 A; 219/205, 267, 270, 553

[56] References Cited

U.S. PATENT DOCUMENTS

| | | | |
|---|---|---|---|
| 2,898,571 | 8/1959 | Moule et al. | 123/145 A |
| 4,211,204 | 7/1980 | Glauner et al. | 123/145 A |
| 4,312,120 | 1/1982 | Comer | 219/270 X |
| 4,359,977 | 11/1982 | Sperner et al. | 123/145 A |
| 4,556,781 | 12/1985 | Bauer | 123/145 A X |
| 4,636,614 | 1/1987 | Itoh et al. | 123/145 A X |
| 4,733,053 | 3/1988 | Mueller | 123/145 A X |
| 4,934,349 | 6/1990 | Demizu | 123/145 A X |
| 4,963,717 | 10/1990 | Woelfle | 123/145 A X |

FOREIGN PATENT DOCUMENTS

| | | | |
|---|---|---|---|
| 3825013 | 1/1990 | Fed. Rep. of Germany . | |
| 1215013 | 12/1970 | United Kingdom | 219/270 |

*Primary Examiner*—Willis R. Wolfe

*Attorney, Agent, or Firm*—Sixbey, Friedman, Leedom & Ferguson

[57] ABSTRACT

An incandescent plug for an air-compressing internal combustion engine, with a plug body (3), with a connector (5) for the application of electrical current and with an incandescent tube (2) which is attached to the plug body at one end is closed at its opposite end, and a wire filament-like resistance element (4) which embedded in an electrically insulating material (7) in the incandescent tube (2), is able to be heated with lower electrical output by the wire filament-shaped resistance element (4) being confined within the region of the opposite end of the incandescent tube which is remote from the plug body (3).

17 Claims, 8 Drawing Sheets

INCANDESCENT PLUG

BACKGROUND OF THE INVENTION

The invention relates to an incandescent plug for air-compressing internal combustion engines having a plug body with a connecting device mounted on the plug housing for receiving heating current, an incandescent tube that is mounted on the plug housing and which is closed at an end opposited the plug housing, and a wire filament-like resistance element embedded within an electrically insulating material within the incandescent tube.

Measurements conducted on diesel-engined vehicles have shown that in some running conditions, the combustion chamber temperature and therefore the incandescent tube temperature of unheated (currentless) incandescent plugs (glow plugs) is approx. 400° to 500° C. Since misfire-free operation is only achieved at a temperature above approx. 850° C., these running conditions are accompanied by poor exhaust gas and noise behaviour. It is therefore expedient to allow the incandescent plugs to be switched on at least periodically.

In the case of the known rod-shaped incandescent plugs of the type mentioned at the outset U.S. Pat. No. 4,556,781, (German Offenlequngsschriff 38 25 013), the filament-like resistance element extends over the total length of the incandescent tube. These known rod-shaped incandescent plugs require for a constant temperature of approx. 900° to 1000° C. and an electrical output of more than 120 W per plug in still air.

Such a high electrical output is not available for continuous operation which is why a known incandescent plug of this type is a failure as a continuous incandescent ignition energiser.

SUMMARY OF THE INVENTION

The object of the invention is to provide an incandescent plug of which the incandescent tube can be heated with a lower electrical output and while the engine is running at a temperature of around 850° C.

According to the invention, this problem is resolved by an incandescent plug in which the resistance element is confined to a region within the end of the incandescent tube that is opposite that connected to the plug housing. More particularly this region represents less than one-third of the free length of the incandescent tube.

BRIEF DESCRIPTION OF THE DRAWINGS

Embodiments of the invention will be described hereinafter with reference to the accompanying drawings in which.

DETAILED DESCRIPTION OF THE PREFERRED EMBODIMENT

Figure 1:
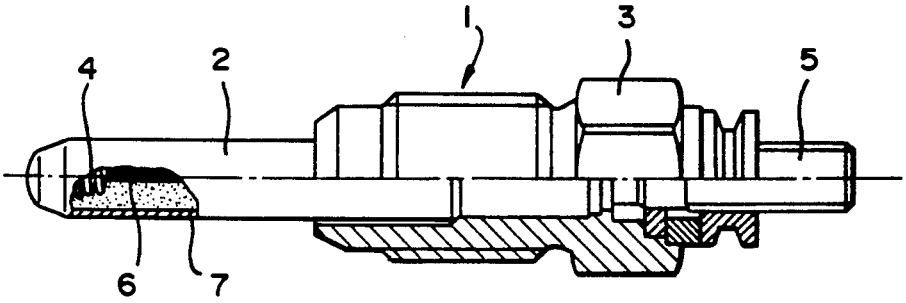
FIG. 1 shows a first embodiment of an incandescent plug according to the invention.
Figure 1A:
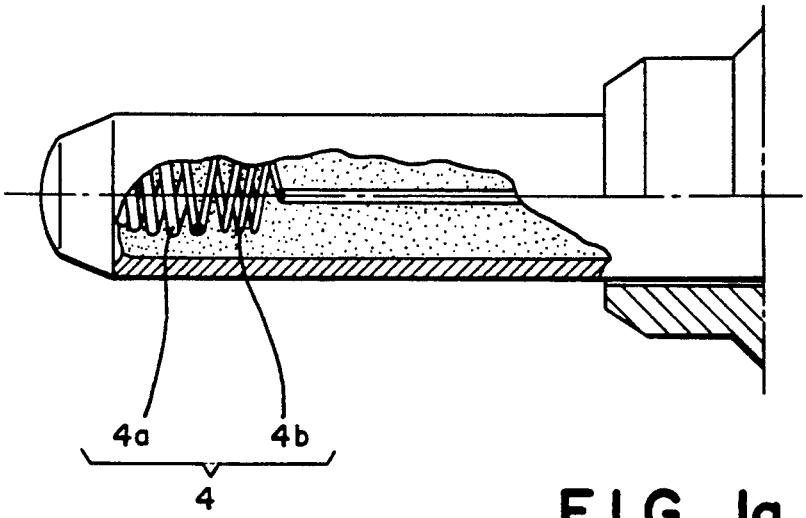
FIG. 1*a* shows a second embodiment of an incandescent plug according to the invention.

FIG. 1 shows an incandescent plug 1 with an incandescent plug body 3 and a tube 2 which is closed at its end which is remote from the incandescent plug body 3. For electrical heating of the tube 2, a wire resistance filament 4 hereinafter referred to as the heat filament, is disposed in the tip of the incandescent tube 2, i.e. it is concentrated at the end of the tube 2 which is remote from the body 3. The heater filament 4 consists of a heater wire the resistance of which is largely independent of the temperature (e.g. Kanthal). In a further embodiment, the heater filament 4 may consist entirely or, as shown in FIG. 1*a*, where the heater filament comprises the part 4*a* of substantially temperature-independent resistance or with a resistance of weakly positive or negative temperature coefficient and the part 4*b* with a markedly positive temperature coefficient (the spatial disposition of parts 4*a* and 4*b* can also be interchanged), partially of a heating wire with a regulating characteristic (e.g.: Ni, CoFe, Fe, . . . ). Thus, a certain auto-control of the incandescent plug is achieved. If the current strength in the heater filament is limited by the electronic control arrangement, then subject to a correspondingly temperature-resistant material being used for the heater filament, also a uniformly negative temperature coefficient may be advantageous.

In any case, however, the entire heater filament, in other words including that of the possibly existing part which has a regulating characteristic, may be concentrated in the tip of the incandescent tube.

This area is confined to a maximum of 10 mm and preferably 4 to 7 mm and if at all possible it should occupy an area representing less than ⅓ the free length of the incandescent tube.

Since the choice of material (specific resistance) and the choice of the wire diameter will impose limits, this spatial concentration can be improved by the following measures:

- reduction in the distance between turns
- the use of insulated (e.g. surface oxidised) wires which can be wound without any gap between the turns
- coaxial disposition of a plurality of windings
- reduction in the total resistance.

For the establishment of an electrical contact between the heater filament 4 and a connecting part 5 which is disposed on that side of the incandescent plug body 3 which is remote from the incandescent tube 2, a low-ohm connection 6 of for example a nickel wire, is provided, which preferably passes through the incandescent tube in a stretched condition. By means of an electrically insulating material 7 in the form of a granulate the heater filament 4 is embedded in the incandescent tube 2. Normally MgO is used as the insulation material. In order to improve the heat conductivity between the heater filament 4 and the incandescent tube 2, it is possible in this portion of the incandescent tube to use an insulation material of higher heat conductivity (e.g. $AlN_2$), while in the region of the low-ohm wire junction an insulation material of lesser heat conductivity is used. The spatial elongation of the heater filament 4 is intentionally concentrated at the tip of the incandescent tube in order to minimise the incandescent volume. Thus, the electrical output which has to be employed to attain a specific incandescent plug temperature can be kept low. This low electrical output is the prerequisite of continuous operation of the incandescent plug. Furthermore, the losses due to convection, irradiation and heat conduction are thus minimised.

Figure 2:
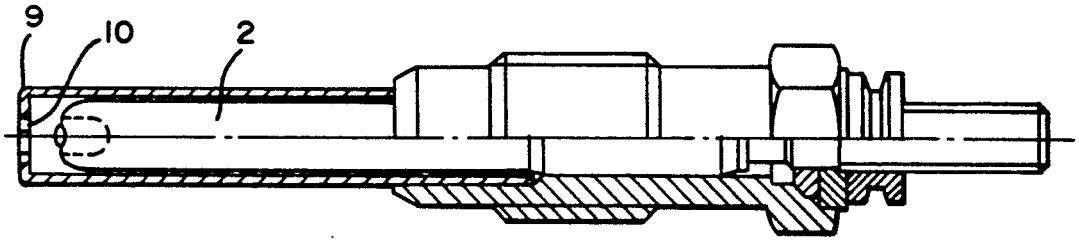
FIG. 2 shows a third embodiment of an incandescent plug according to the invention, with a protective tube.

FIG. 2 shows a further embodiment of an incandescent plug in which for further reduction of the heat losses at low temperatures in the combustion chamber or in the pre-chamber of the engine during gas exchange processes a protective tube 9 is provided which encloses the incandescent tube 2. In the region of the incandescent tube end, at the tip and/or on the periphery of the protective tube 9, there is or are one or a plurality of apertures 10 which allow the fuel-air mixture access to the glowing end of the incandescent tube where the fuel-air mixture is then ignited. Additionally, it is a function of the protective tube 9, at very high combustion chamber temperatures, to prevent overheating of the heated incandescent tube. This embodiment is particularly suitable for use in engines with very high gas exchange velocities and thus high convection losses.

Figure 3:
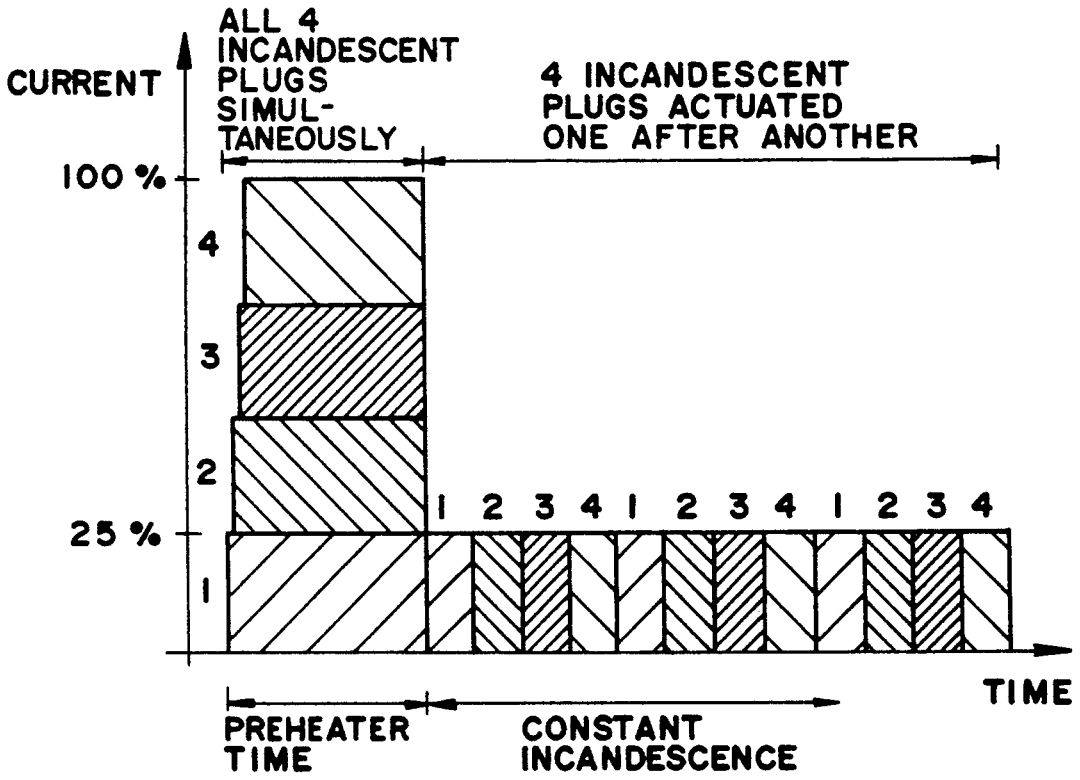
FIG. 3 shows the pattern of an incandescent plug control arrangement for a 4-cylinder engine.

FIG. 3 diagrammatically shows the excitation of the incandescent plugs taking a 4-cylinder engine as an example. An electrical switching instrument controls the individual incandescent plugs, e.g. via power switching transistors which are cut in and out according to the vehicle status.

All four incandescent plugs are operated simultaneously during the preheating phase.

In order to reduce the steepness of the connection current, it is advantageous if the individual incandescent plugs are cut in one after another with a slight time lag. the duration of the preheater phase can be altered as a function of various parameters such as the outside temperature, cooling water temperature, supply voltage, incandescent plug resistance. At the end of the preheater period, the incandescent plugs can be timed to be switched on one after another so that overheating of the incandescent plugs is avoided. Electrically, the incandescent plugs are so designed that with a connection time of 25% the desired incandescent plug temperature of for instance >850° C. is reached at any travelling status. The timed sequence of connection of the four incandescent plugs so that the connection phases are immediately adjacent to one another without any gap nor overlap, has the advantage that the inboard supply network is subjected to a virtually constant current.

According to the way the electrical values of the incandescent plugs are designed, so it may be advantageous after the preheating phase to interpolate an intermediate heating phase with 50% to 75% of the connection time. In this case, two or three incandescent plugs will remain heated simultaneously.

It is particularly advantageous if the incandescent plugs are tested by the control instrument to determine their functioning capacity so that any defects can be made known to the driver. Such a testing phase may be envisaged both before the preheating phase and also during the respective timing pauses of the individual incandescent plugs. If a heater filament of temperature-dependent resistance is used for the incandescent plugs, then the filament temperature may also be monitored.

Figure 4:
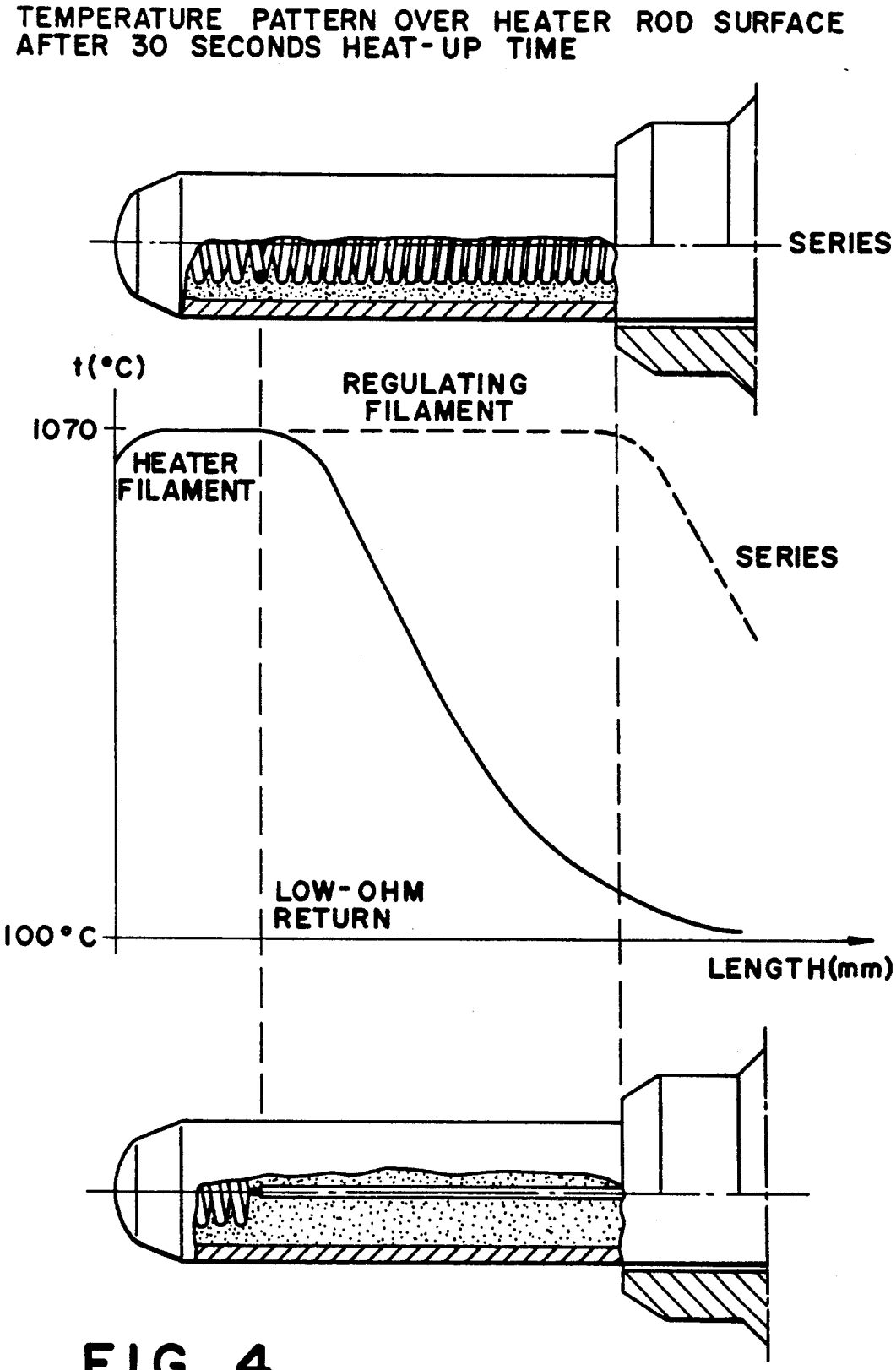
FIG. 4 shows the temperature curve on the incandescent tube surface for an incandescent tube according to FIG. 1.

FIG. 4 shows the pattern of temperatures on the incandescent tube surface after a heat-up time of 30 seconds. Compared with the prior art incandescent plug with a resistance filament (broken line) extending over the entire length of the incandescent tube, where the incandescent plug according to FIG. 1 is concerned (the solid line) the glowing volume is concentrated on the tip of the tube; the entire electrical energy is converted in the region of the tip of the incandescent tube, where the wire resistance filament is concentrated. In contrast, in the case of the prior art incandescent plug, the major part of the electrical energy is converted in the region of the regulating part of the wire resistance filament which extends over the greater part of the length of the incandescent tube on the side which is towards the body of the incandescent plug. In the case of the incandescent plug which is the object of the present invention, this part of the tube is measured by a low-ohm return. By reducing the incandescent volume in the case of the incandescent plug which is the object of the invention, heat losses are kept so low during engine operation that with a justifiable energy (<50 W) the tip of the incandescent tube assumes a temperature of >850° C.

Figure 5:
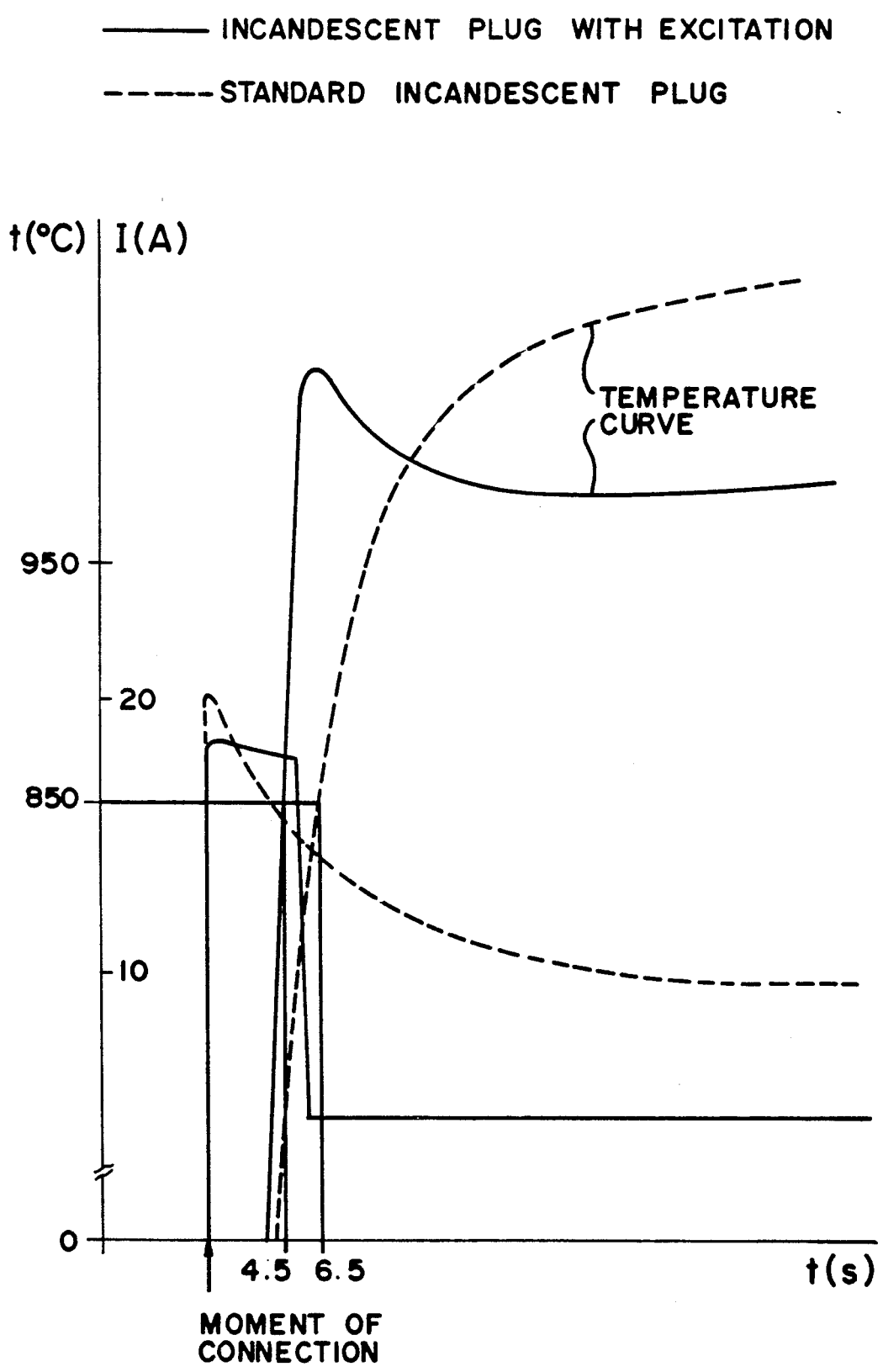
FIG. 5 shows the heating-up pattern for an incandescent plug according to FIG. 1 and that of a known incandescent plug.

Furthermore, by virtue of the concentration of the converted electrical energy in the tip of the incandescent tube, a more rapid heating-up is achieved, which is shown in FIG. 5. In FIG. 5, both the glow current is shown in relation to the time just as the surface temperature on the tip of the incandescent tube is also shown. The prior art incandescent plug (broken line) starts with a high initial current peak which leads to heating of the regulating filament. Due to the rising resistance of the regulating filament, the incandescent current diminishes and the regulating filament takes over the major part of the electrical energy. It takes approx. 6.5 seconds to attain a temperature of 850° C. at the tip of the incandescent tube, and about 9.5 seconds to attain a temperature of 950° C.

In the case of the incandescent plug which is the object of the invention, during the preheating phase, a virtually constant heating current flows. The entire electrical energy is converted in the tip of the incandescent tube and the temperature of 850° C. is reached in 4.5 seconds while a temperature of 950° C. is reached in 5.5 seconds. After the preheating time, the incandescent plug is operated on a 25% connection time. Thus, where the temperature curve is concerned, a peak temperature occurs during the preheating phase after which the temperature approximates a constant value.

Figure 6:
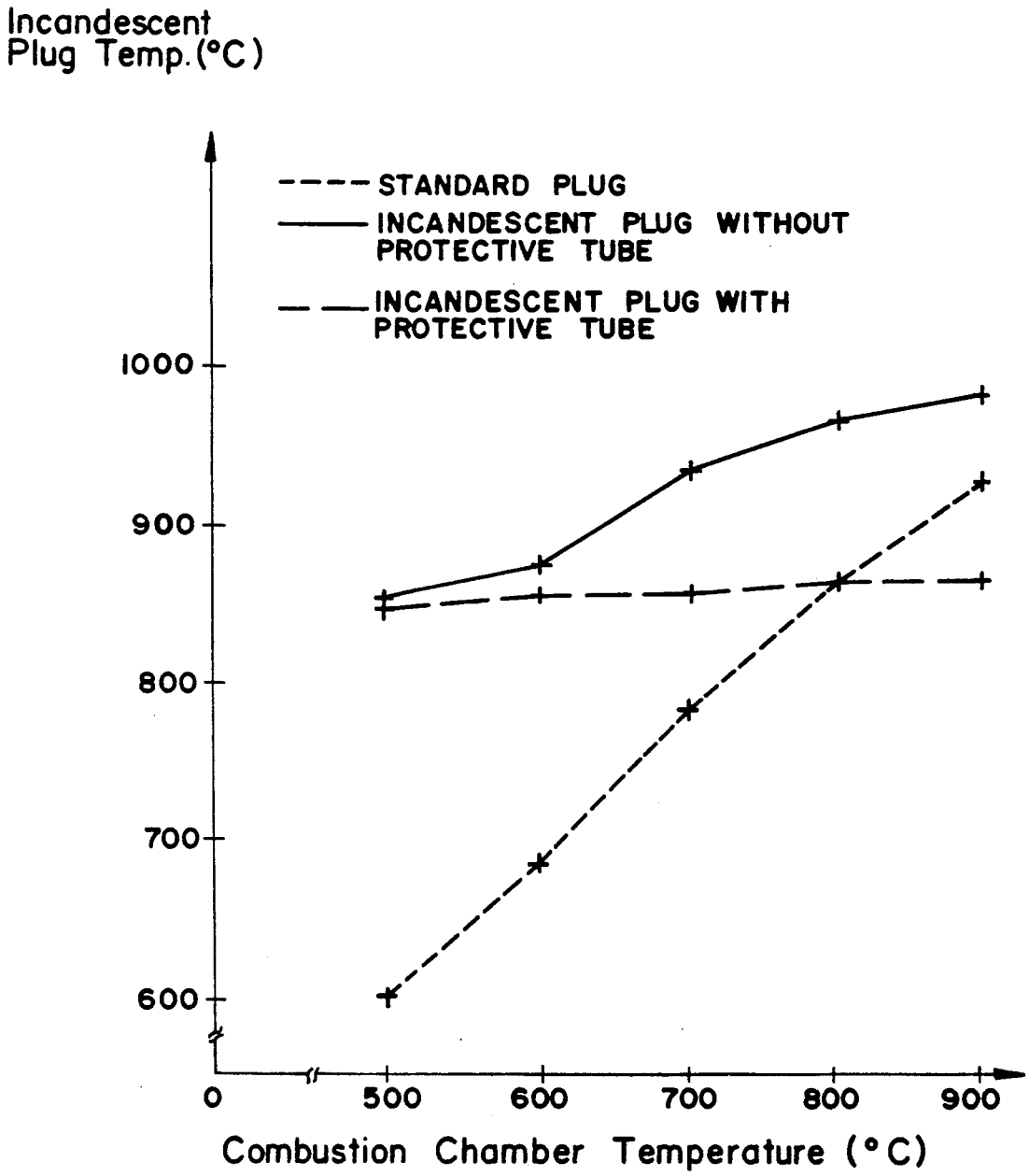
FIG. 6 shows the incandescent tube temperature during engine operation and with a constant heating output in comparison with a known incandescent plug and one according to the invention.

A comparison between the known mass-produced incandescent plug and the incandescent plug according to the invention (FIG. 6) during operation of the engine with a constant heating output of approx. 40 W produce the following result. At any combustion chamber temperature, the mass-produced incandescent plug produced only a minimal temperature rise whereas the incandescent plug according to the invention assumed a temperature of >850° C. at every travelling situation. In the case of the embodiment of incandescent plug without a protective tube, as shown in FIG. 1, at high combustion chamber temperatures, the temperature rises to approx. 1000° C. The incandescent plug with a protective tube, according to FIG. 2, exhibits a virtually constant temperature over the entire travelling range at the tip of the incandescent tube. This can be attributed solely to the screening effect of the protective tube. Thus, the effective life of the incandescent plug can be further enhanced. At high combustion chamber temperatures, the protective tube absorbs a higher temperature and so acts as a glow ignition energiser.

In order to demonstrate the effect of continuous incandescence on the combustion process, exhaust gas comparative measurements were carried out.

Figure 7:
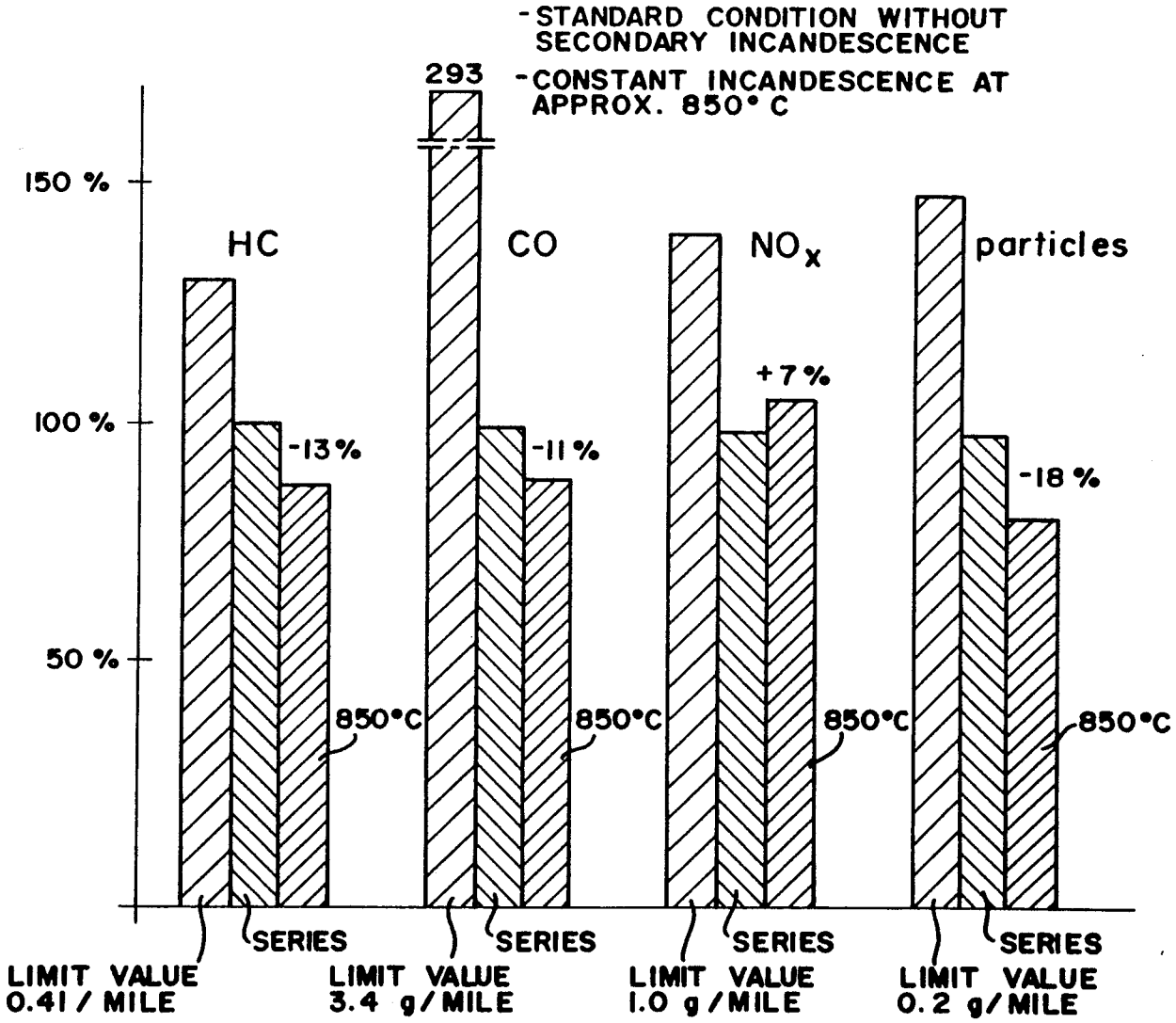
FIG. 7 shows the result of a comparative test of exhaust gases with continuous incandescence, FIG. 8 diagrammatically shows the fitment of an incandescent plug according to FIG. 1 into a swirl chamber of a diesel engine and FIG. 9 diagrammatically shows a control device which is supplied with varying input magnitudes.

FIG. 7 shows the exhaust gas levels for a US cycle, a Volkswagen Golf Diesel being taken as the example. For this purpose, the series situation (without constant incandescence) was standardised at 100%. In comparison, the currently valid US limits are shown on the graph. The heating rod temperature of the incandescent plug according to FIG. 1 was externally regulated to 850° C.

Due to the better combustion, the values for hydrocarbons (HC) and carbon monoxide (CO) were markedly reduced. By reason of the higher combustion temperature, as expected, the $NO_x$ value rose somewhat. The improved HC and CO values point to a misfire-free operation. Also particle emissions were considerably improved by the continuous incandescence, which is likewise attributable to better combustion.

Since the heated tip of the incandescent plug results in a reduction in ignition delay, then a moment of ignition which must be determined afresh by the vehicle manufacturers can be calculated by a further exhaust gas or particle reduction.

Shortening the ignition delay is known to result in a reduction in the combustion noise and general sound through the air.

It can be expected that as a result of constant incandescence in conjunction with further engine-related measures (combustion chamber design, adjustment of the moment at which injection takes place) future particle limit values can also be observed even without a soot filter.

Figure 8:
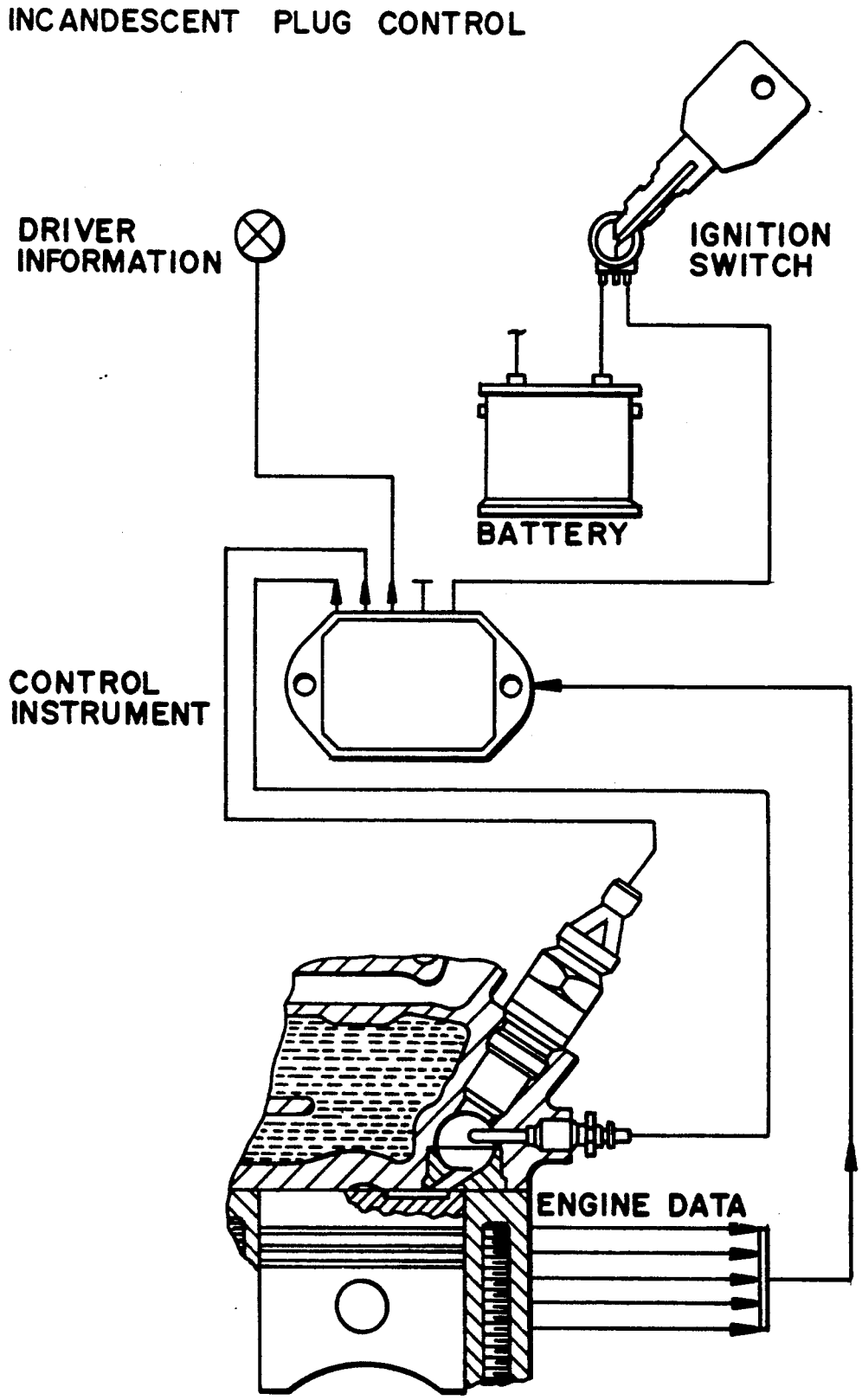

FIG. 8 diagrammatically shows the fitment of an incandescent plug according to FIG. 1 in a swirl chamber of a diesel engine. The central control arrangement ascertains the various engine parameters and supplies the incandescent plugs with a corresponding heating output. In addition, this control arrangement may also take over control of injection and monitoring of the incandescent plugs.

Figure 9:
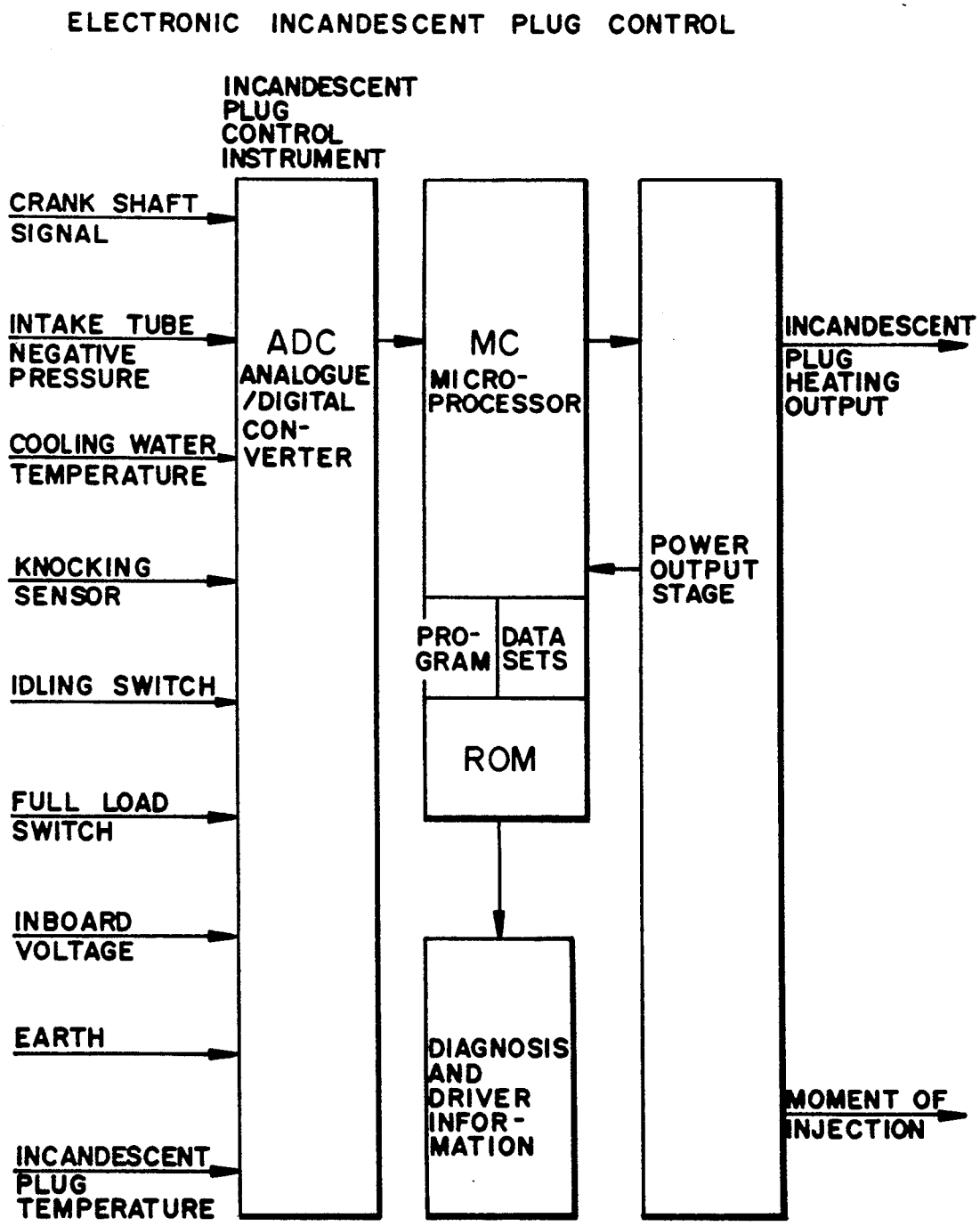

FIG. 9 diagrammatically shows the control arrangement which is supplied with the various input magnitudes. This data is processed in a microprocessor in accordance with a predetermined programme, the microprocessor then initiating the final stage of output. In a memory component, engine-specific data and characteristics may be stored. In addition, the microprocessor conducts functional monitoring (diagnosis) of the incandescent plugs and reports any defects to the driver.

We claim:

1. An arrangement comprising a set of incandescent plugs, each of which comprises a plug body, with a connector for the application of electrical current and with, mounted on the plug body, an incandescent tube which has one end mounted on the plug body and an opposite end which is closed, and a wire filament-like resistance element embedded in an electrically insulating material in the incandescent tube; wherein the wire filament-shaped resistance element is confined within a region of said opposite end of the incandescent tube, and control means for simultaneously applying an electrical current to all of the plugs of the set of incandescent plugs during an initial connection phase time period and for individually supplying current to the plugs in a continuous one-at-a-time sequence in a second connection phase during which the supply of current to one plug is terminated as the supply of current to a successive plug is commenced.

2. An arrangement set according to claim 1, wherein the control means is operable for causing the second connection phase to commence with a minimal time lag following said first connection phase.

3. An incandescent plug for an air-compressing internal combustion engine, comprising: a plug body, with a connector for the application of electrical current mounted on the plug body, an incandescent tube which has one end mounted in the plug body and an opposite tip end which is closed, and a wire filament-like, coil-shaped resistance element embedded in an electrically insulating material in the incandescent tube; wherein the wire filament-like, coil shaped resistance element is confined within a region of said incandescent tube beginning at said opposite tip end of the incandescent tube, said resistance element having a length that is less than one-third of a free length of the incandescent tube which extends outside of the plug body to said opposite tip end.

4. An incandescent plug according to claim 3, wherein the resistance element has a uniform temperature characteristic.

5. An incandescent plug according to claim 4, wherein the electrical resistance of the resistance element is substantially independent of temperature.

6. An incandescent plug according to claim 4, wherein the electrical resistance of the resistance element has a positive temperature coefficient with a regulating effect.

7. An incandescent plug according to claim 4, wherein the electrical resistance of the resistance element has a negative temperature coefficient.

8. An incandescent plug according to claim 3, wherein the resistance element comprises a part first of substantially a temperature independent resistance and a part (4*b*) of a positive temperature coefficient with a regulating effect.

9. An incandescent plug according to claim 8, wherein a low-ohm wire connection is provided for connecting the resistance element to the connector.

10. An incandescent plug according to claim 9, the electrically insulating material is a material which has a comparatively high heat conductivity.

11. An incandescent plug according to claim 10, wherein the electrically insulating material of comparatively high thermal conductivity is confined to said region and an electrically insulating material of relatively low thermal conductivity is provided in an area of said low-ohm wire connection.

12. An incandescent plug according to claim 11, wherein a protective tube enclosed the incandescent tube, said protective tube being provided with apertures in an area surrounding said region of the incandescent tube.

13. An incandescent plug according to claim 3, wherein a low-ohm wire connection is provided for connecting the resistance element to the connector.

14. An incandescent plug according to claim 13, the electrically insulating material is a material which has a comparatively high heat conductivity.

15. An incandescent plug according to claim 14, wherein the electrically insulating material of comparatively high thermal conductivity is confined to said region and an electrically insulating material of relatively low thermal conductivity is provided in an area of said low-ohm wire connection.

16. An incandescent plug according to claim 3, the electrically insulating material is a material which has a comparatively high heat conductivity.

17. An incandescent plug according to claim 3, wherein a protective tube enclosed the incandescent tube, said protective tube being provided with apertures in an area surrounding said region of the incandescent tube.

* * * * *